US007735268B1

(12) United States Patent
Zidar et al.

(10) Patent No.: US 7,735,268 B1
(45) Date of Patent: Jun. 15, 2010

(54) WALL RESTRAINT SYSTEM

(75) Inventors: Robert J. Zidar, Brookfield, WI (US); James F. Jendusa, Oconomowoc, WI (US)

(73) Assignee: Engineered Foundation Products, LLC, Brookfield, WI (US)

( * ) Notice: Subject to any disclaimer, the term of this patent is extended or adjusted under 35 U.S.C. 154(b) by 566 days.

(21) Appl. No.: 11/649,507

(22) Filed: Jan. 4, 2007

Related U.S. Application Data

(63) Continuation-in-part of application No. 10/976,448, filed on Oct. 28, 2004, now abandoned.

(51) Int. Cl.
*E04G 23/04* (2006.01)

(52) U.S. Cl. ..... 52/127.2; 52/146; 52/170; 52/696; 52/693; 248/351; 248/300

(58) Field of Classification Search ..... 52/127.2, 52/127.1, 146, 170, 657, 697, 696, 693, 702, 52/695, 638; 248/351, 354.1, 201, 300, 218, 248/357, 219.2, 219.4; 405/285
See application file for complete search history.

(56) References Cited

U.S. PATENT DOCUMENTS

| | | | | | |
|---|---|---|---|---|---|
| 1,660,496 | A | * | 2/1928 | Symons | 248/357 |
| 1,730,618 | A | * | 10/1929 | Mayo | 254/104 |
| 1,783,266 | A | * | 12/1930 | Symons | 248/357 |
| 1,825,912 | A | * | 10/1931 | Markham | 248/357 |
| 1,829,550 | A | * | 10/1931 | Symons | 248/357 |
| 2,101,317 | A | * | 12/1937 | Lemieux | 403/53 |
| 2,331,247 | A | * | 10/1943 | Symons | 248/357 |
| 2,537,863 | A | * | 1/1951 | Sato | 248/357 |
| 2,772,799 | A | * | 12/1956 | Bridinger | 414/462 |
| 2,850,254 | A | * | 9/1958 | Houseworth | 254/100 |
| 3,203,660 | A | * | 8/1965 | Bowden | 248/357 |
| 3,231,230 | A | * | 1/1966 | Mueller | 248/449 |
| 3,281,160 | A | * | 10/1966 | Vinther et al. | 254/420 |
| 3,356,330 | A | * | 12/1967 | Rambelle | 248/354.5 |
| 3,418,740 | A | * | 12/1968 | Gray | 40/313 |
| 3,537,220 | A | * | 11/1970 | Ellis | 52/223.5 |
| 3,713,259 | A | * | 1/1973 | Tkach | 52/111 |
| 4,304,078 | A | * | 12/1981 | Meriwether, Jr. | 52/127.2 |
| 4,404,780 | A | * | 9/1983 | Josephson | 52/126.7 |
| 4,412,599 | A | * | 11/1983 | McCrudden et al. | 182/201 |

(Continued)

FOREIGN PATENT DOCUMENTS

| | | | | |
|---|---|---|---|---|
| FR | 36795 | * | 9/1981 | 182/52 |

*Primary Examiner*—Phi Dieu Tran A
(74) *Attorney, Agent, or Firm*—Donald J. Ersler

(57) ABSTRACT

An apparatus for bracing a masonry wall that is bowing or has begun to buckle as a result of hydrostatic pressure and/or other forces as may occur with the foundation or basement wall of a building. The wall restraint system includes a vertically disposed beam, which is positioned against a vertical concrete masonry wall and secured in place by a bottom bracket and a top bracket. The beam reinforces the wall and prevents further bowing, buckling, or potentially collapsing of the wall. One end of the beam is secured to the floor by a bottom bracket. The bottom bracket preferably receives the lower end of the beam. The upper end of the beam is secured against the basement wall by a top bracket or offset connector, which in turn is secured to one of the overhead floor joists. The beam may be offset to avoid piping or the like.

19 Claims, 18 Drawing Sheets

U.S. PATENT DOCUMENTS 4,527,827 A * 7/1985 Maniscalco et al. ..... 224/405
4,596,371 A * 6/1986 Clark ..... 248/354.3
4,682,460 A * 7/1987 Reetz ..... 52/632
4,704,829 A * 11/1987 Baumker, Jr. ..... 52/127.2
4,757,651 A 7/1988 Crites ..... 52/169.5
4,763,878 A * 8/1988 Abraham et al. ..... 254/100
4,870,789 A * 10/1989 Clark et al. ..... 52/126.6
5,230,198 A * 7/1993 Callies ..... 52/702
5,271,596 A * 12/1993 Holcomb et al. ..... 249/24
5,377,462 A * 1/1995 Beals et al. ..... 52/127.2
5,459,967 A * 10/1995 Bodtker ..... 52/93.1
5,620,038 A * 4/1997 DeCola et al. ..... 160/209
5,638,914 A * 6/1997 Kizzia ..... 182/45
5,704,171 A * 1/1998 Ruff et al. ..... 52/127.2
5,845,450 A * 12/1998 Larsen ..... 52/574
6,042,074 A * 3/2000 Cusimano ..... 248/354.1
6,293,058 B1 * 9/2001 Sink ..... 52/127.1
6,334,738 B1 * 1/2002 Juracko ..... 405/132
6,591,570 B2 * 7/2003 Miller, Jr. ..... 52/632
6,662,505 B2 * 12/2003 Heady et al. ..... 52/127.2
6,758,015 B2 * 7/2004 Clasen et al. ..... 52/73
7,152,835 B1 * 12/2006 Riblet ..... 248/246
7,380,372 B2 * 6/2008 Resch et al. ..... 52/127.2
7,526,899 B1 * 5/2009 Oliver et al. ..... 52/292
7,610,733 B2 * 11/2009 Rizzotto ..... 52/745.21
2001/0029715 A1 * 10/2001 Bradley et al. ..... 52/344
2006/0080926 A1 4/2006 Resch et al. ..... 52/474
2007/0102614 A1 * 5/2007 McKinney ..... 248/351

* cited by examiner

WALL RESTRAINT SYSTEM

CROSS-REFERENCE TO RELATED APPLICATIONS

This application is a continuation-in-part patent application taking priority from nonprovisional application Ser. No. 10/976,448, filed on Oct. 28, 2004 now abandoned.

BACKGROUND OF THE INVENTION

The present invention relates generally to a wall restraint system, and more particularly to an apparatus for bracing a concrete or masonry wall that is bowing or has begun to buckle as a result of hydrostatic pressure and/or other external forces as may occur with the foundation or basement wall of a building.

Modern foundations are typically formed of concrete block walls or poured concrete walls. Concrete block walls are constructed of concrete blocks stacked with alternating vertical joints using mortar between the joints to hold the blocks together. Poured concrete walls are constructed by setting concrete wall forms, installing steel reinforcing bars, and pouring concrete into the forms to create walls. Poured concrete walls are desirous for their strength, stability, and endurance. However, they do trap moisture, creating a wetter, more humid basement. Concrete block walls are desirous for their openings and pores allowing moisture to escape, creating a drier, less humid basement. Unfortunately, concrete block walls tend to be less resistant to lateral forces attributed to hydrostatic pressures, causing the walls to buckle, crack, and potentially collapse.

The need for reinforcing concrete masonry walls is prevalent in areas where there is a high water table, heavy absorbent clay soil, and freezing and thawing of soil. Structures built in these areas tend to experience higher instances of foundation problems, including the bowing and buckling of concrete masonry walls. The prior art bracing system solution for bowing and buckling of concrete masonry walls includes installing a series of vertical support reinforcing restraints along the bowed or buckled wall. These restraints are typically engineered steel beams that are bolted to the floor joist and bolted through the basement floor or footing with brackets. A top bracket is generally welded to the upper end of the beam, while a bottom bracket is welded to the bottom end of the beam. Additionally, holes must be drilled through the beams or brackets for securing the beam to the basement floor or floor joist. Currently, each beam is custom fabricated for each job and welded to the brackets. Such requirements substantially increase the labor and costs associated with installing these prior art bracing systems.

Additionally, U.S. Pat. No. 4,757,651 to Crites discloses a wall system; U.S. Pat. No. 5,845,450 to Larsen discloses a bracing system; U.S. Pat. No. 6,662,505 to Heady et al. discloses an apparatus and method of straightening and supporting a damaged wall; and patent application no. 2006/0080926 to Resch et. al. discloses a wall bracing system and method of supporting a wall.

Therefore, there is a need for an economical wall restraining system that is less expensive and easier to install than the custom fabricated prior art bracing systems requiring welding and drilling during installation on buckled concrete masonry walls.

SUMMARY OF THE INVENTION

The present invention preferably comprises a vertically disposed beam, which is positioned in engaging relation with a vertical concrete masonry wall and secured in place by a bottom bracket and a top bracket. The beam reinforces the wall and prevents further bowing, buckling, or potentially collapsing of the wall. One end of the beam is preferably secured to the basement floor or footings by a bottom bracket. The bottom bracket preferably receives the lower end of the beam therein and is secured to the basement floor or footings with fasteners. The upper end of the beam is preferably secured against the wall by a top bracket which, in turn, is secured to one of the overhead floor joists. The top bracket preferably engages the upper end of the beam, is secured to a floor joist, and urges the beam against the wall. The top bracket is preferably further secured to the floor joist by fasteners.

The wall restraint system of the present invention does not need any fabrication, customization, welding or drilling as required in the prior art bracing systems. The present invention utilizes less expensive, easy to assemble parts.

Various other features, objects, and advantages of the invention will be made apparent to those skilled in the art from the accompanying drawings and detailed description thereof.

DETAILED DESCRIPTION OF THE INVENTION

Figure 1:
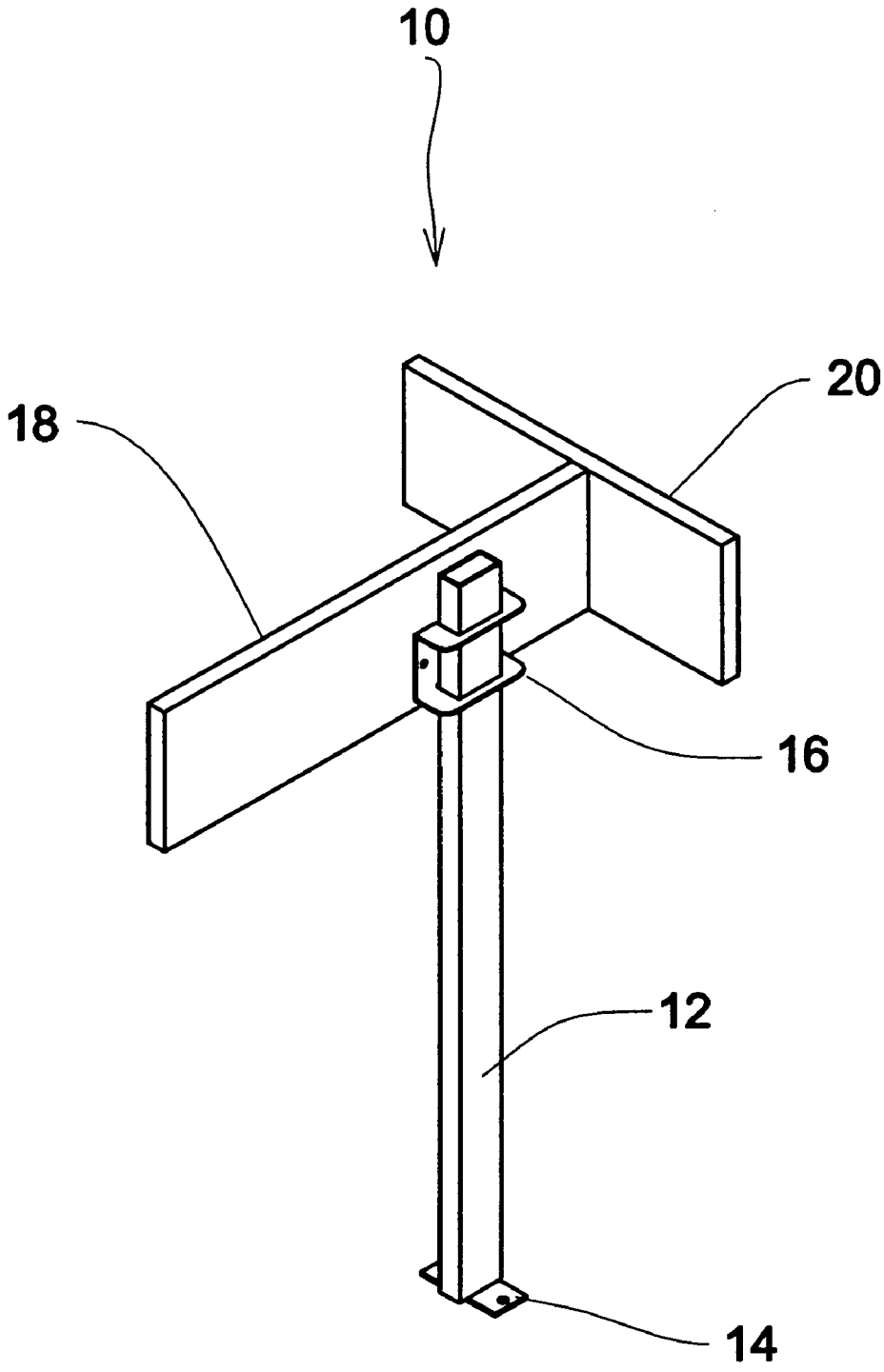
FIG. 1 is a perspective view of an embodiment of a wall restraint system attached to a floor joist in accordance with the present invention.

Referring now to the drawings, FIG. 1 illustrates an embodiment of a wall restraint system 10 attached to a floor joist 18 in accordance with the present invention. The wall restraint system 10 preferably includes a vertically disposed beam 12 which is positioned in engaging relation with a vertical concrete masonry wall 22 and secured in place by a bottom bracket 14 and a top bracket 16. The present invention assumes a basement of conventional construction, which includes a basement floor with concrete masonry walls extending upwardly therefrom. The floor joists for the floor of the building are positioned on top of the concrete masonry walls and are secured at their respective ends to conventional plates as is known in the art.

The beam 12 is preferably a rigid rectangular tubular member constructed of steel having dimensions of 2×4, 2×5 or 2×6, and lengths depending upon the height of the walls for which they are installed. However, beams of various sizes, dimensions, and lengths may be used. The beams are preferably designed to engage a basement wall for reinforcing the wall and preventing the wall from bowing, buckling and/or collapsing. One surface of the beam bears against the wall, providing a strong bearing surface for the wall. Several beams may be required to bolster a single wall against buckling. In this arrangement, the beams will be spaced apart a few or several feet as required. The beams engage the wall and cooperate with the brackets and floor joists to prevent further buckling and collapse.

One end of the beam 12 is preferably secured to a floor or footings adjacent the wall by a bottom bracket 14. The bottom bracket 14 preferably receives the lower end of the beam 12 therein and is secured to the floor or footings with fasteners. The beam 12 is preferably hollow to receive a portion of the bottom bracket 14 therein.

Figure 2:
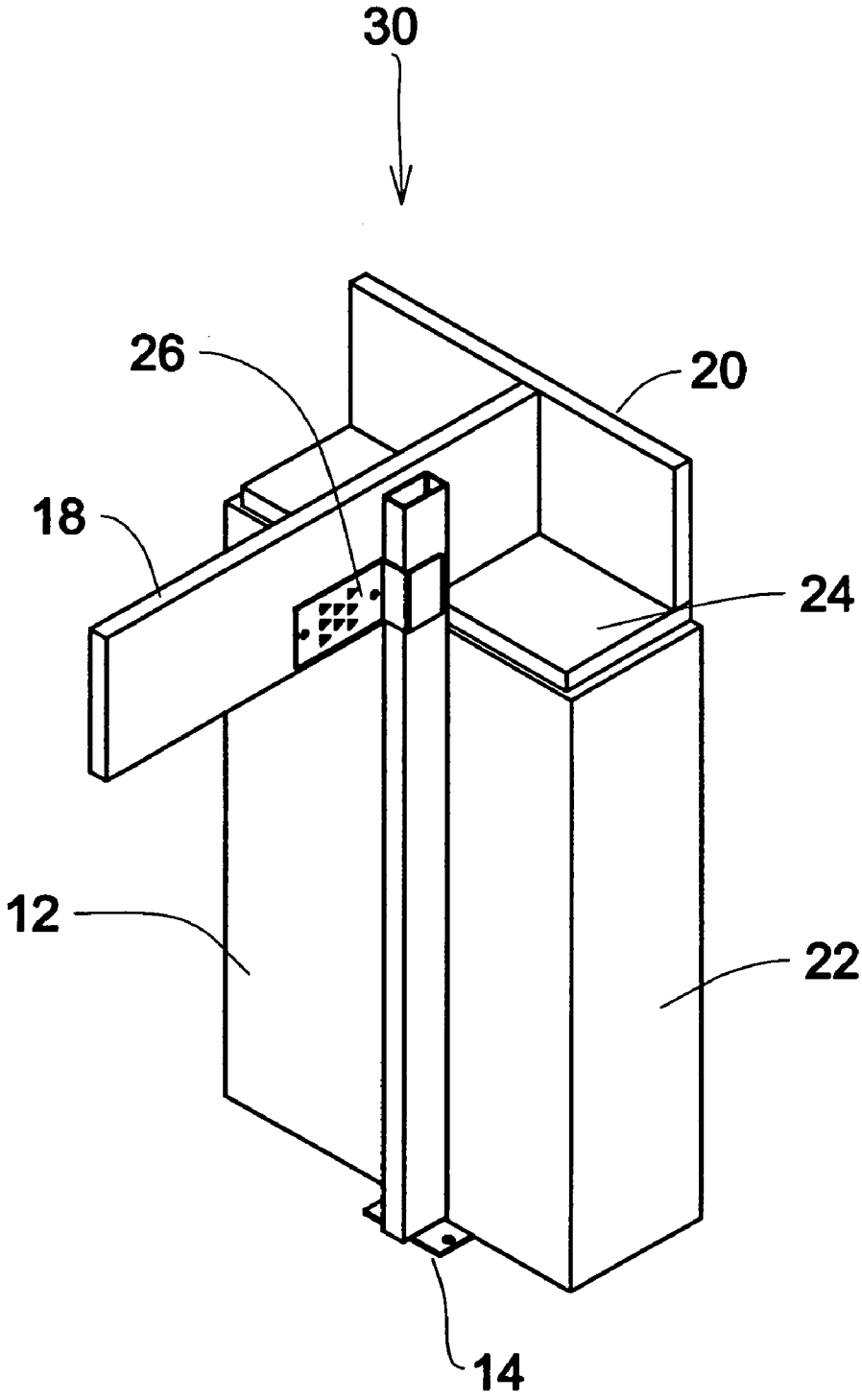
FIG. 2 is a perspective view of another embodiment of a wall restraint system attached to a floor joist and positioned against a wall in accordance with the present invention.
Figure 3A:
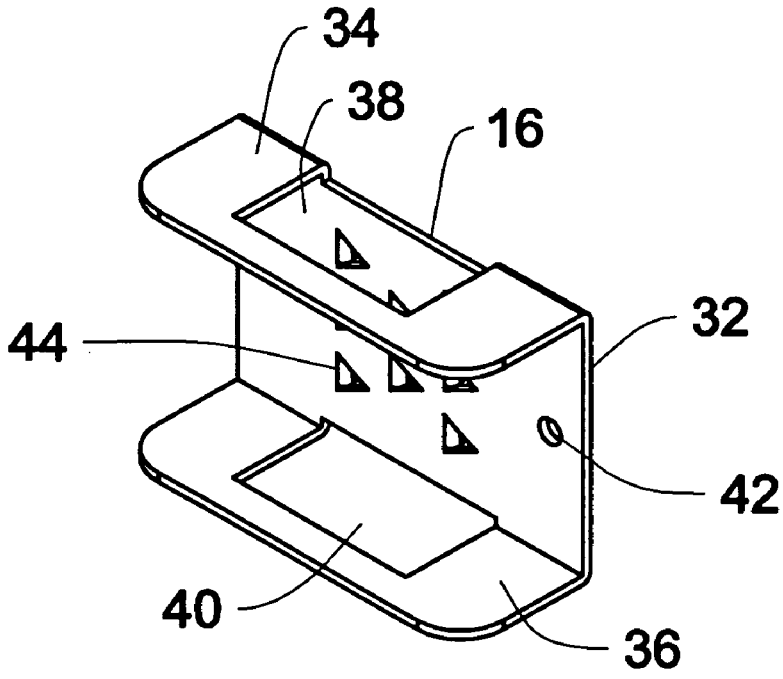
FIG. 3A is an enlarged front perspective view of an embodiment of a top bracket utilized in the wall restraint system of FIG. 1.
Figure 3B:
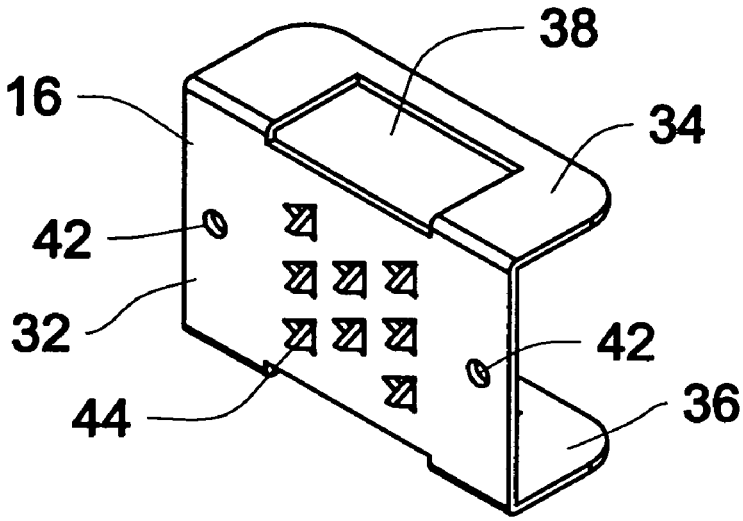
FIG. 3B is an enlarged rear perspective view of the top bracket of FIG. 3A.
Figure 4A:
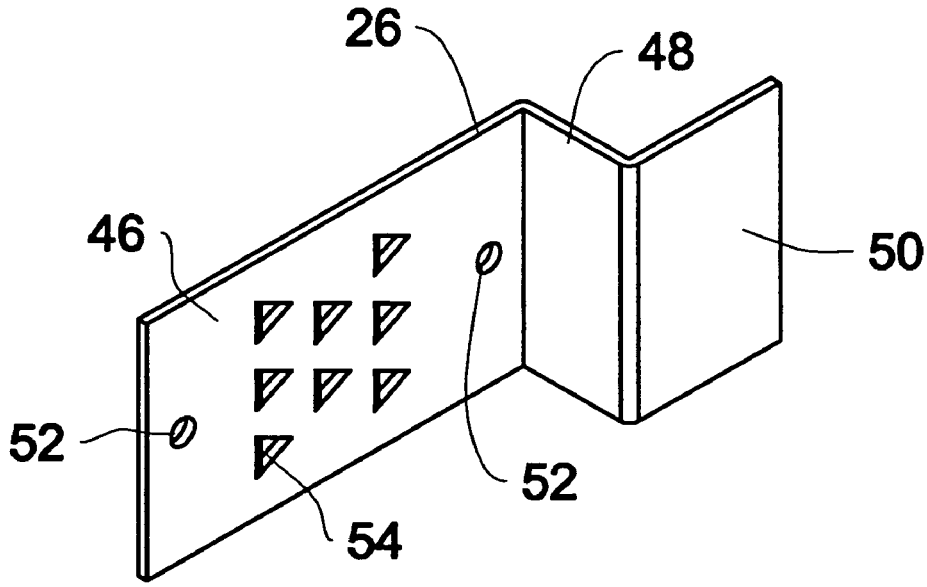
FIG. 4A is an enlarged front perspective view of another embodiment of a top bracket utilized in the wall restraint system of FIG. 2.
Figure 4B:
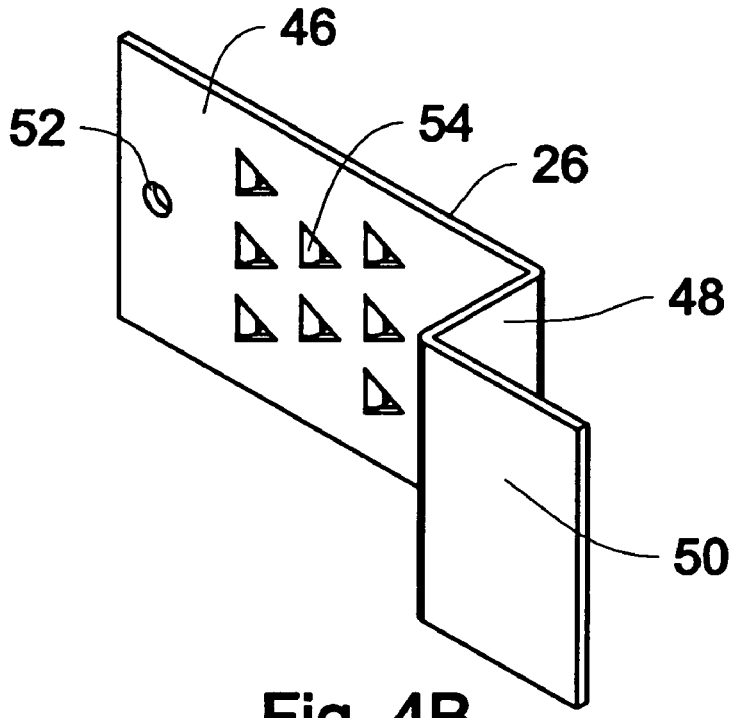
FIG. 4B is an enlarged rear perspective view of the top bracket of FIG. 4A.

The upper end of the beam 12 is preferably secured against the wall by a top bracket 16 which, in turn, is secured to one of the overhead floor joists 18 by fasteners. FIGS. 1, 3A and 3B show one embodiment of a top bracket 16, while FIGS. 2, 4A and 4B show another embodiment of a top bracket 26. The top bracket 16 engages the upper end of the beam 12, is secured to an adjacent floor joist 18, and urges the beam 12 against the wall.

FIG. 2 illustrates another embodiment of a wall restraint system 30 attached to a floor joist 18 and positioned against a wall 22 in accordance with the present invention. The only difference between the wall restraint system 10 of FIG. 1 and the wall restraint system 30 of FIG. 2 is the top bracket. FIG. 1 shows one embodiment of the top bracket 16, while FIG. 2 shows another embodiment of the top bracket 26.

The wall restraint system 30 preferably includes a vertically disposed beam 12 which is positioned in engaging relation with a vertical concrete masonry wall 22 and secured in place by a bottom bracket 14 and a top bracket 26. The floor joist 18 is positioned upon the top of the concrete wall 22 and is secured at its respective end to conventional plates 20, 24.

One end of the beam 12 is preferably secured to the basement floor or footings adjacent the basement wall by a bottom bracket 14. The bottom bracket 14 preferably receives the lower end of the beam 12 therein and is secured to the floor or footings with fasteners. The beam 12 is preferably hollow to receive a portion of the bottom bracket 14 therein.

The upper end of the beam 12 is preferably secured against the wall by a top bracket 26 which, in turn, is secured to one of the overhead floor joists 18 by fasteners. The top bracket 26 engages the upper end of the beam 12, is secured to an adjacent floor joist 18, and applies a force against the upper end of the beam 12 toward the wall 22.

FIGS. 3A and 3B illustrate front and rear perspective views of an embodiment of a top bracket 16 utilized in the wall restraint system 10 of the present invention. The top bracket 16 preferably comprises a substantially flat rectangular base plate 32 having a front surface and a rear surface, parallel longitudinal edges, and parallel transverse edges. The top bracket 16 also preferably includes two opposing flanges 34, 36 extending outwardly from the front surface of the base plate 32 at each of the parallel longitudinal edges perpendicular from the base plate 32. The flanges 34, 36 each including rectangular openings 38, 40 formed therethrough for receiving the beam 12 therein. The openings 38, 40 may preferably be constructed to fit a 2×4 inch rectangular beam, a 2×5 inch rectangular beam, or a 2×6 inch rectangular beam.

The base plate 32 further preferably includes a plurality of prongs 44 and a pair of openings 42 disposed on opposite sides of the prongs 44. The triangularly-shaped prongs 44 preferably have sharp points extending outwardly from the rear surface of the base plate 32 for biting into the floor joist 18. The pair of openings 42 extending through the base plate 32 are for receiving fasteners therein for further securing the bracket 16 to the floor joist 18.

FIGS. 4A and 4B illustrate front and rear perspective views of another embodiment of a top bracket 26 utilized in the wall restraint system 30 of the present invention. The top bracket 26 preferably comprises a substantially flat rectangular base plate 46 having a front surface and a rear surface, parallel longitudinal edges, and parallel transverse edges. The top bracket 26 also preferably includes an L-shaped portion 48, 50 extending outwardly from one of the parallel transverse edges for receiving the beam 12. The L-shaped portion having a first section 48 extending perpendicular from the front surface of the base plate 46 and a second section 50 extending perpendicular from the end of the first section 48 and parallel to the base plate 46. The L-shaped portion 48, 50 may be constructed to fit a 2×4 inch rectangular beam, a 2×5 inch rectangular beam, or a 2×6 inch rectangular beam.

The base plate 46 further preferably includes a plurality of prongs 54 and a pair of openings 52 extending through the base plate 46 and disposed on opposite sides of the prongs 54. The triangularly-shaped prongs 54 preferably have sharp points extending outwardly from the rear surface of the base plate 46 for biting into the floor joist 18. The pair of openings 52 extending through the base plate 46 are for receiving fasteners therein for further securing the bracket 26 to the floor joist 18.

Figure 5:
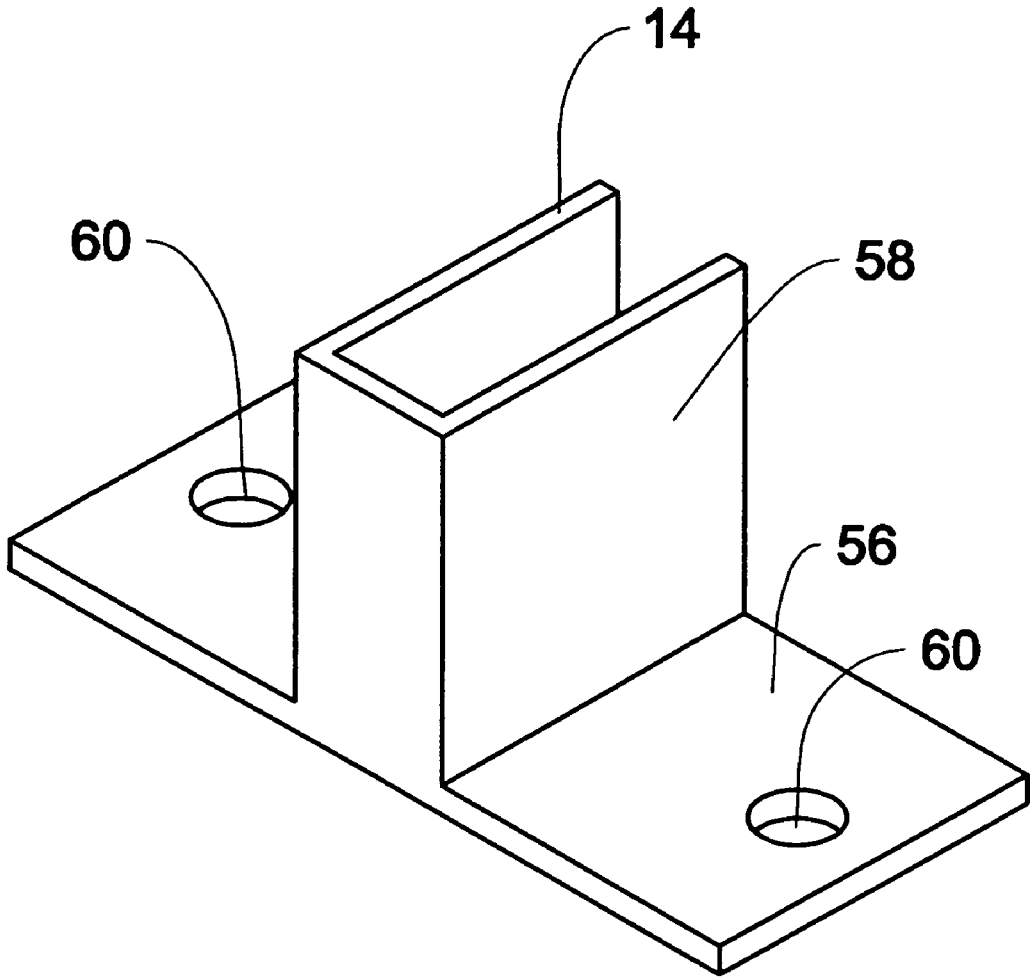
FIG. 5 is an enlarged perspective view of a bottom bracket utilized in the wall restraint systems of FIGS. 1, 2, 6, 6*a*, 8, 8*a*, 14 and 17.
Figure 5A:
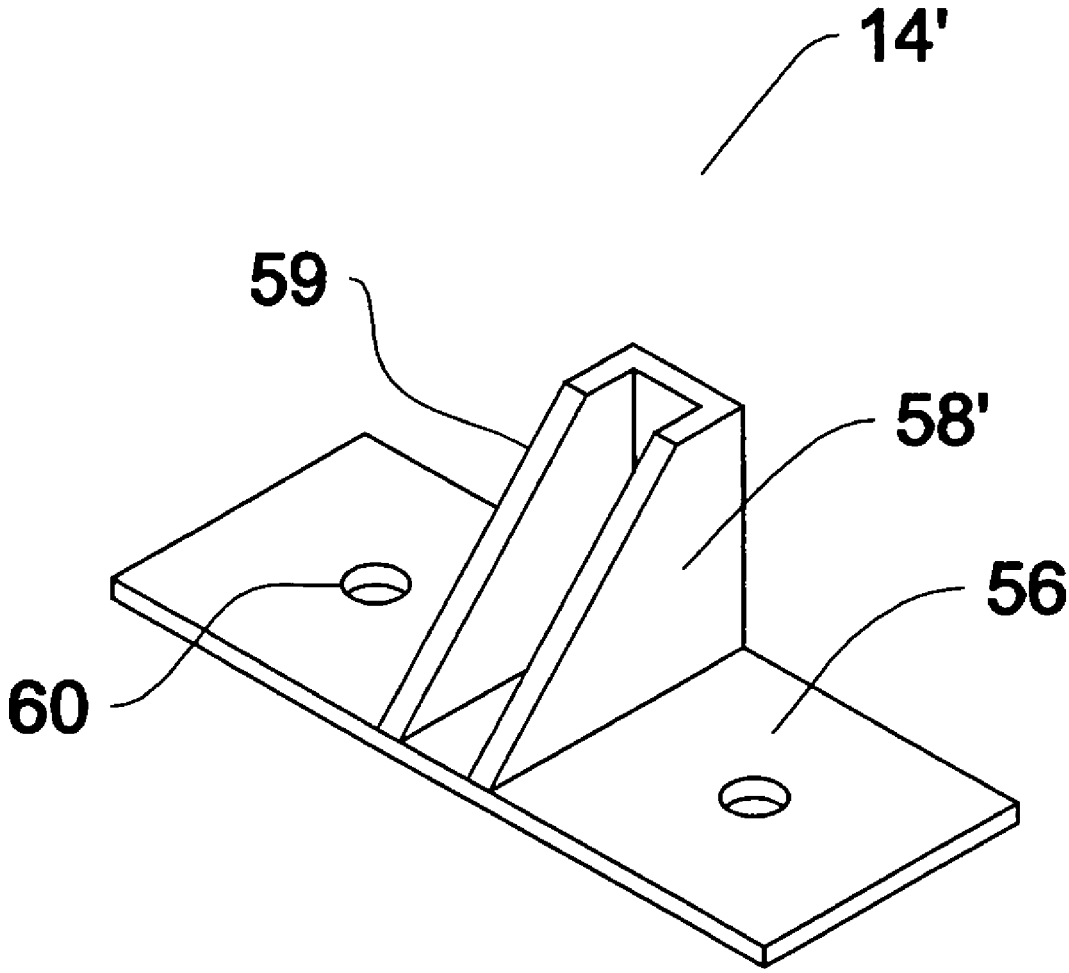
FIG. 5*a* is an enlarged perspective view of another embodiment of a bottom bracket utilized in the wall restraint systems of FIGS. 1, 2, 6, 6*a*, 8, 8*a*, 14 and 17.

FIG. 5 illustrates an enlarged perspective view of an embodiment of a bottom bracket 14 utilized in the wall restraint systems of the present invention. The bottom bracket 14 preferably comprises a substantially flat rectangular base plate 56 having a top surface and a bottom surface, and a U-shaped or rectangularly-shaped portion 58 extending upwardly perpendicular from the base plate 56 for insertion into the hollow beam 12. As mentioned earlier, the beam is preferably hollow, with the beam sides fitting snuggly around the U-shaped or rectangularly-shaped portion 58 of the bottom bracket 14. The base plate 56 further preferably includes a pair of openings 60 extending therethrough and disposed on opposite sides of the U-shaped or rectangularly-shaped portion 58. The pair of openings 60 extending through the base plate 56 are for receiving fasteners therein for securing the bracket 14 to the basement floor or basement footings. The bottom bracket 14 is also preferably provided in several sizes as required to accommodate the varying sizes of the beam 12. FIG. 5*a* illustrates the bottom bracket 14 being modified by forming a pair of chamfered surfaces 59 on the rectangularly-shaped portion 58 to create a bottom bracket 14'. The pair of chamfered surfaces 59 allow for angular adjustment of the beam 12 relative to the bottom bracket 14'.

Figure 6:
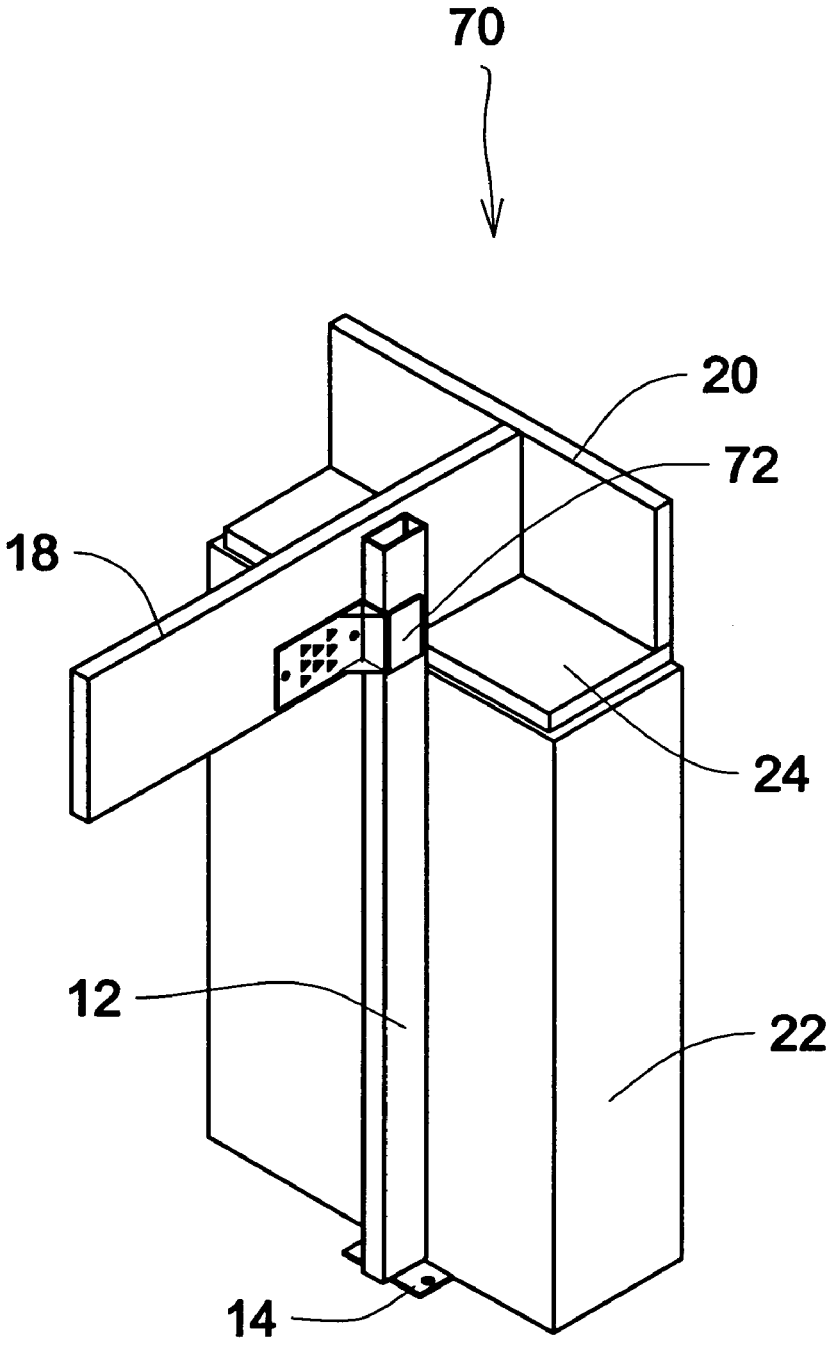
FIG. 6 is a perspective view of yet another embodiment of a wall restraint system attached to a floor joist in accordance with the present invention.
Figure 7A:
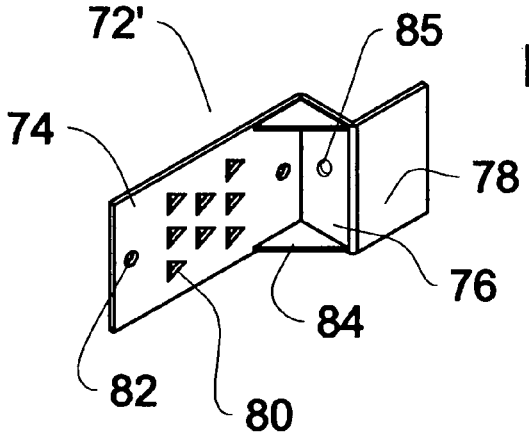
FIG. 7*a* is an enlarged perspective view of a top bracket utilized in the wall restraint system of FIG. 6*a* in accordance with the present invention.
Figure 7B:
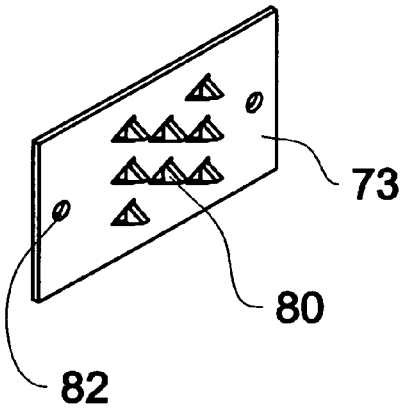
FIG. 7*b* is an enlarged perspective view of an anchor washer utilized in the wall restraint system of FIG. 6*a* in accordance with the present invention.
Figure 7:
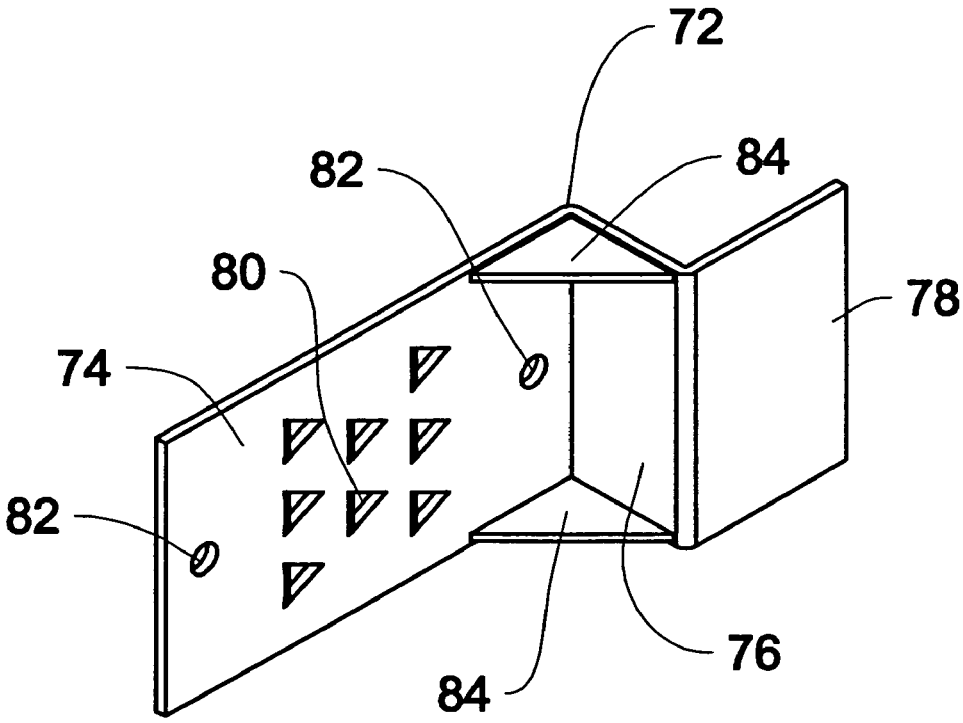
FIG. 7 is an enlarged front perspective view of yet another embodiment of a top bracket utilized in the wall restraint system of FIG. 6.

FIG. 6 is a perspective view of yet another embodiment of a wall restraint system 70 attached to a floor joist in accordance with the present invention. The wall restraint system 70 of FIG. 6 is the same as the wall restraint systems 10, 30 of FIGS. 1 and 2 except for the top bracket 72. FIG. 7 illustrates an enlarged front perspective view of yet another embodiment of a top bracket 72 utilized in the wall restraint system 70 of FIG. 6. The top bracket 72 preferably comprises a substantially flat rectangular base plate 74 having a front surface and a rear surface, parallel longitudinal edges, and parallel transverse edges. The top bracket 72 also preferably includes an L-shaped portion 76, 78 extending outwardly from one of the parallel transverse edges for receiving the beam 12. The L-shaped portion having a first section 76 extending perpendicular from the front surface of the base plate 74 and a second section 78 extending perpendicular from the end of the first section 76 and parallel to the base plate 74. The L-shaped portion 76, 78 may be constructed to fit a 2×4 inch rectangular beam, a 2×5 inch rectangular beam, or a 2×6 inch rectangular beam. The bracket 72 further includes at least two bracing members 84 extending between the front surface of the base plate 74 and the first section 76 of the L-shaped portion. The at least two bracing members 84 add strength and help support the bracket 72.

The base plate 74 further preferably includes a plurality of prongs 80 and a pair of openings 82 extending through the base plate 74 and disposed on opposite sides of the prongs 80. The triangularly shaped prongs 80 preferably have sharp points extending outwardly from the rear surface of the base plate 74 for biting into the floor joist 18. The pair of openings 82 extending through the base plate 74 are for receiving fasteners therein for further securing the bracket 72 to the floor joist 18. The plurality of prongs 80 are shown has having a triangular shape, but could be any suitable shape.

Figure 6A:
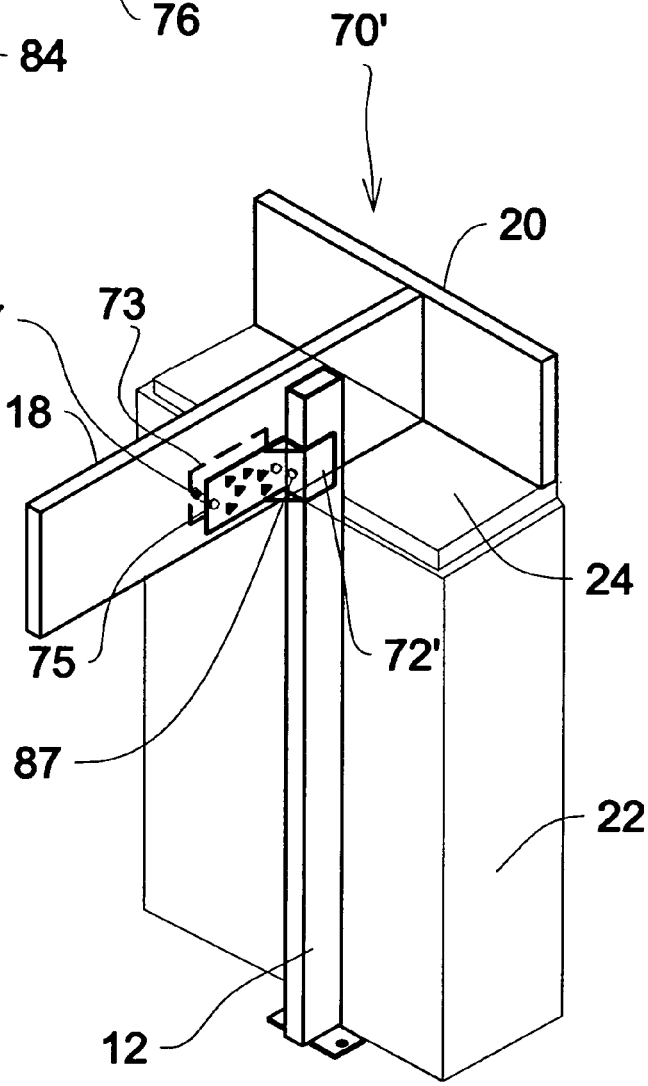
FIG. 6*a* is a perspective view of yet another embodiment of a wall restraint system attached to a floor joist and positioned against a wall in accordance with the present invention.

FIG. 6*a* illustrates a perspective view of a modified wall restraint system 70'. FIG. 7*a* illustrates an enlarged front perspective view of a modified top bracket 72' used in the modified wall restraint system 70'. The wall restraint system 70 is modified by forming an anchor hole 85 through the first section 76. A threaded fastener 87 is inserted through the anchor hole 85 and threaded into the beam 12. FIG. 7*b* illustrates an anchor washer 73. The anchor washer 73 is preferably retained on an opposite side of the floor joist 18 by inserting two fasteners 75 through the top bracket 72 or modified top bracket 72', the floor joist 18 and the anchor washer 73 and securing it thereto with two nuts 77 or the like. The anchor washer 73 includes the pair of openings 82 and the plurality of triangular shaped prongs 80. The plurality of triangular shaped prongs in the anchor washer 73 and the top bracket 72 or modified top bracket 72' prevent the fasteners 75 from splitting the floor joist 18, when force is applied to the top bracket 72 or modified top bracket 72'.

Figure 8:
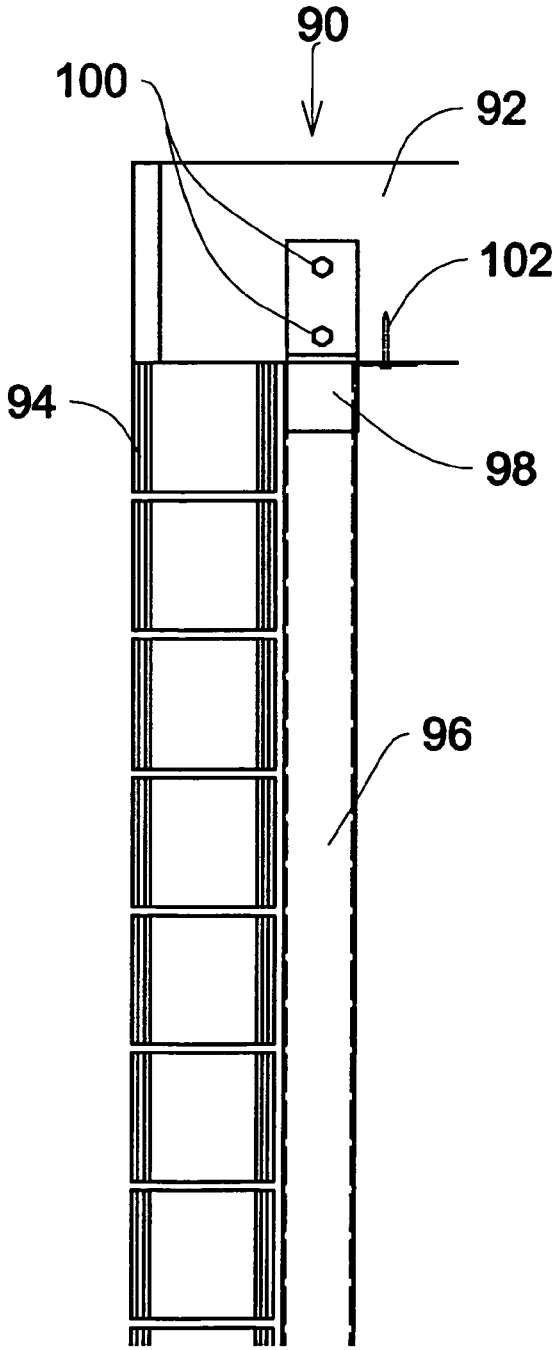
FIG. 8 is a side view of yet another embodiment of a wall restraint system attached to a floor joist in accordance with the present invention.
Figure 9:
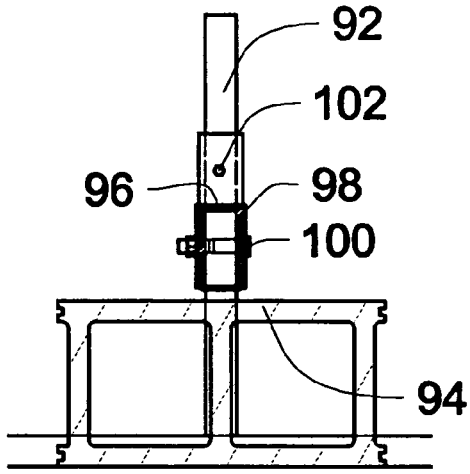
FIG. 9 is a bottom view of the top bracket of the wall restraint system of FIG. 8.
Figure 10:
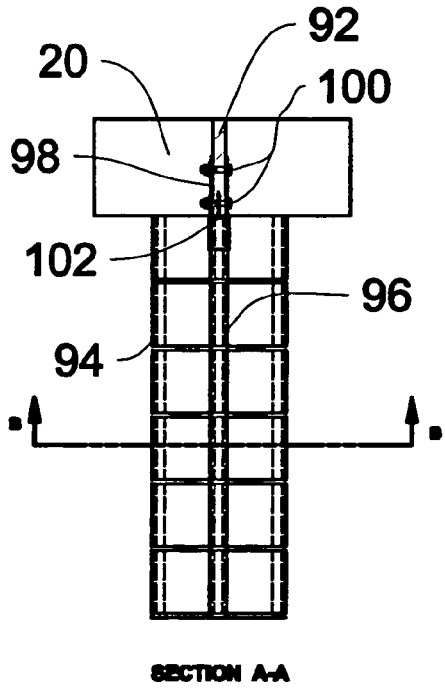
FIG. 10 is a front view of the top bracket of the wall restraint system of FIG. 8.

FIG. 8 illustrates a side view of still another embodiment of a wall restraint system 90 attached to a floor joist 92 and positioned against a wall 94 in accordance with the present invention. FIG. 9 is a bottom view of the top bracket 98 of the wall restraint system 90 of FIG. 8. FIG. 10 is a front view of the top bracket 98 of the wall restraint system 90 of FIG. 8. The wall restraint system 90 preferably includes a vertically disposed beam 96, which is positioned in engaging relation with the wall 94 and secured in place by a bottom bracket (not shown) and a top bracket 98. The floor joist 92 is positioned upon the top of the wall 94 and is secured to the bracket 98 by a plurality of fasteners 100, 102.

Figure 8A:
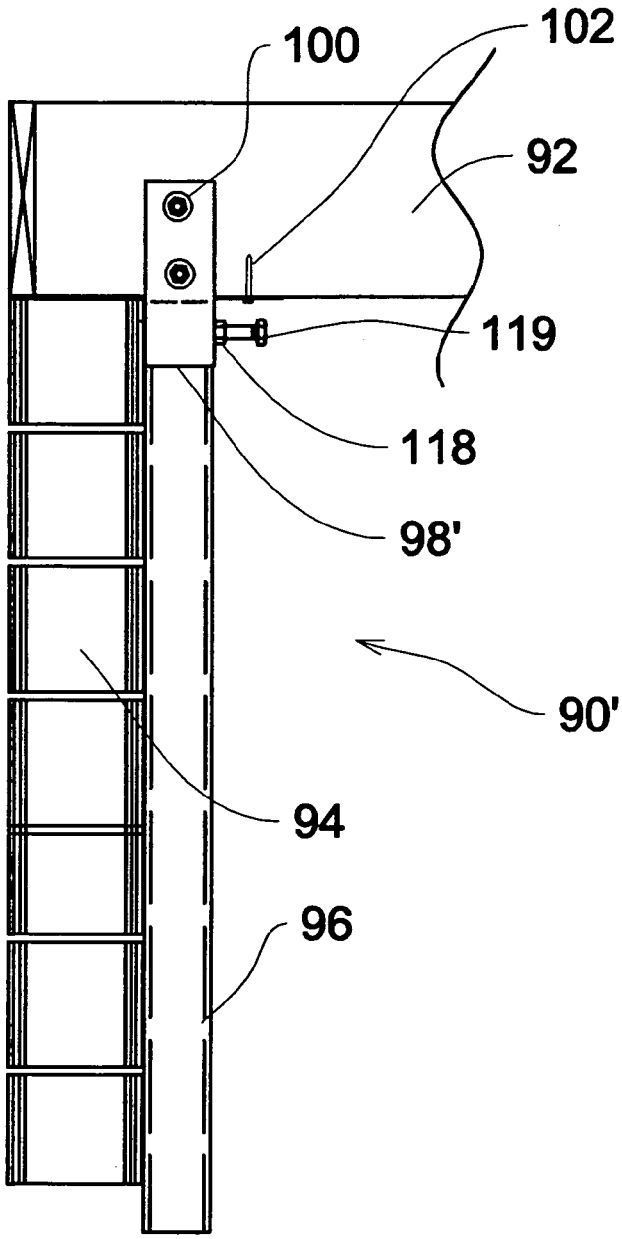
FIG. 8*a* is a side view of yet another embodiment of a wall restraint system attached to a floor joist in accordance with the present invention.
Figure 9A:
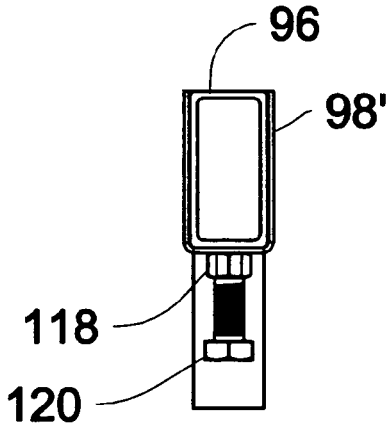
FIG. 9*a* is a bottom view of the top bracket of the wall restraint system of FIG. 8*a;*
Figure 10A:
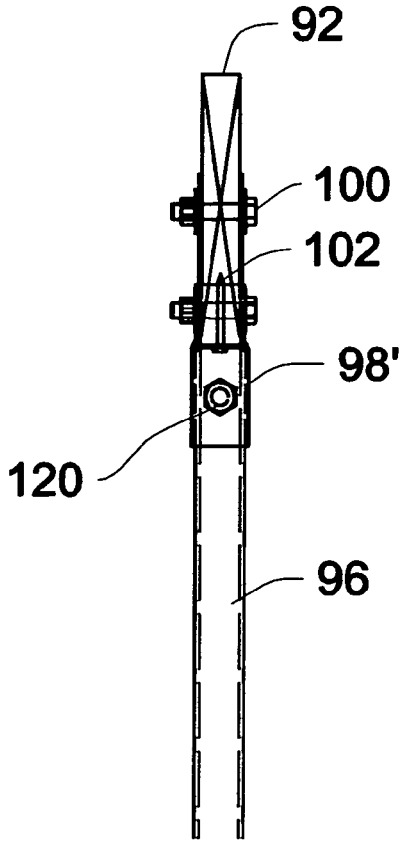
FIG. 10*a* is a front view of the top bracket of the wall restraint system of FIG. 8*a;*

One end of the beam 96 is preferably secured to the basement floor or footings adjacent the basement wall by a bottom bracket (not shown). The bottom bracket preferably receives the lower end of the beam 96 therein and is secured to the floor or footings with fasteners. The beam 96 is preferably hollow to receive a portion of the bottom bracket therein. The upper end of the beam 96 is preferably secured against the wall 94 by a top bracket 98, which, in turn, is secured to one of the overhead floor joists 92 by fasteners 100, 102. The top bracket 98 engages the upper end of the beam 96, is secured to an adjacent floor joist 92. FIG. 8*a* illustrates a side view of a modified wall restraint system 90'. FIG. 9*a* is an enlarged bottom view of a modified top bracket 98' of the wall restraint system 90'. FIG. 10*a* is an enlarged front view of the modified top bracket 98' of the wall restraint system 90'.

Figure 11:
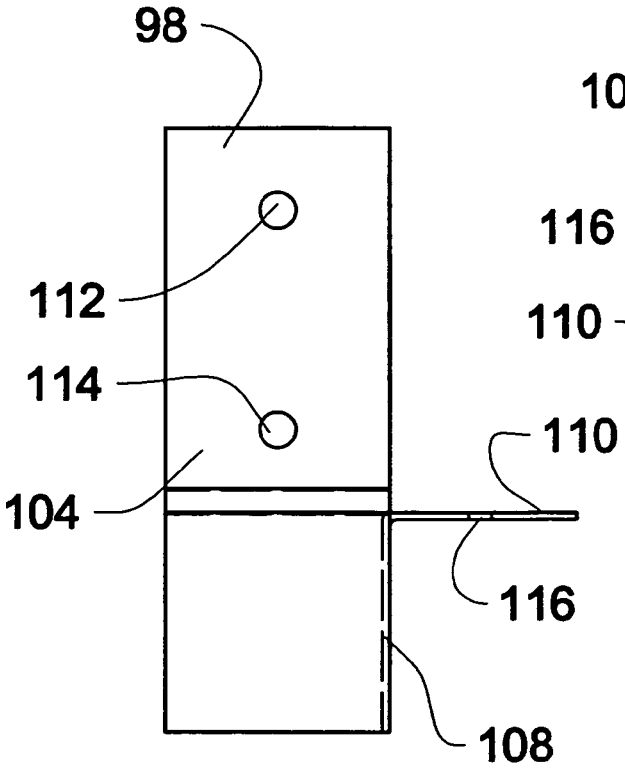
FIG. 11 is an enlarged side view of yet another embodiment of a top bracket utilized in the wall restraint system of FIG. 8.
Figure 13:
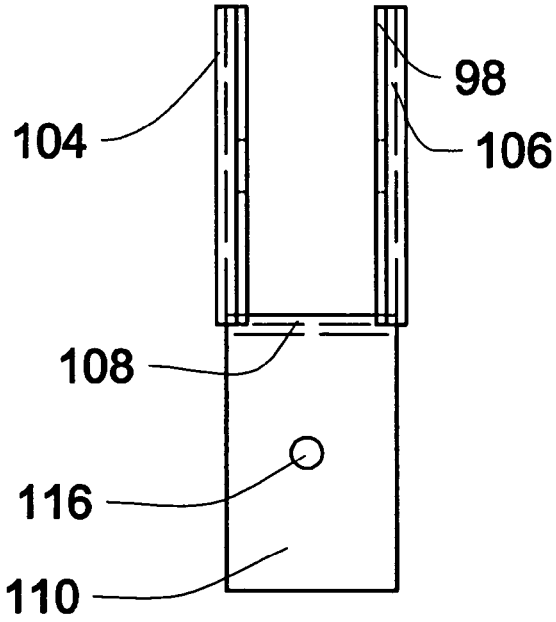
FIG. 13 is a bottom view of the top bracket of FIG. 11.
Figure 12:
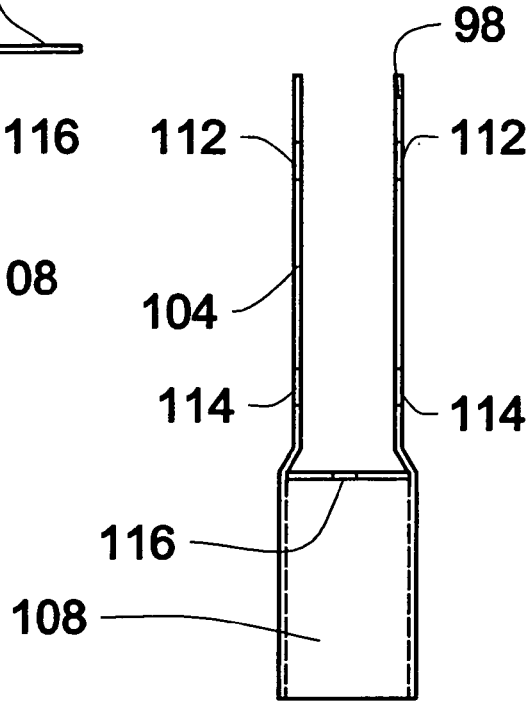
FIG. 12 is a front view of the top bracket of FIG. 11.

FIG. 11 is an enlarged side view of still another embodiment of a top bracket 98 utilized in the wall restraint system of FIG. 8. FIG. 12 is a front view of the top bracket 98 of FIG. 11. FIG. 13 is a bottom view of the top bracket 98 of FIG. 11. The top bracket 98 preferably comprises two spaced apart parallel side members 104, 106, each having a pair of parallel longitudinal edges and a pair of parallel transverse edges. The top bracket 98 also preferably includes a connecting member 108 connection a portion of a longitudinal edge of a first parallel side member 104 to a portion of a longitudinal edge of a second parallel side member 106, and a transverse member 110 extending outwardly at a perpendicular angle from one end of the connecting member 108 between the pair of parallel transverse edges of the parallel side members 104, 106. The parallel side members 104, 106 each have at least two openings 112, 114 extending therethrough for receiving fasteners 100 therein to fasten the bracket 98 to the floor joist 92. The connecting member also includes at least one opening 116 extending therethrough for receiving a fastener 102 therein to fasten the bracket 98 to the bottom of the floor joist 92.

Figure 11A:
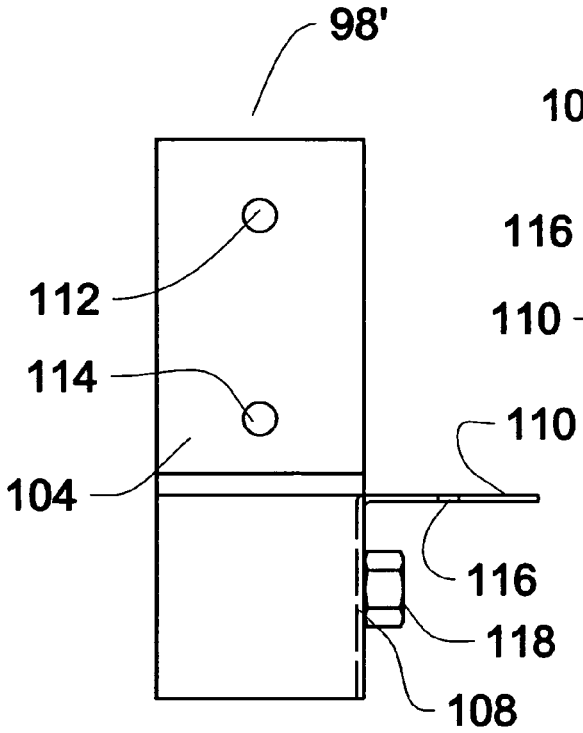
FIG. 11*a* is an enlarged side view of yet another embodiment of a top bracket utilized in the wall restraint system of FIG. 8*a;*
Figure 13A:
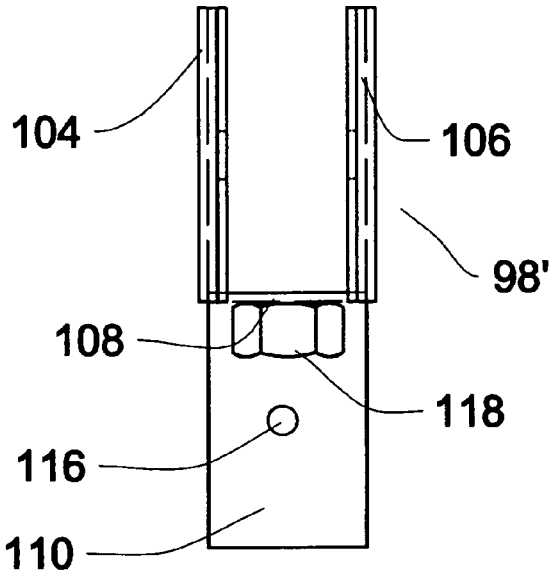
FIG. 13*a* is a bottom view of the top bracket of FIG. 11*a;*
Figure 12A:
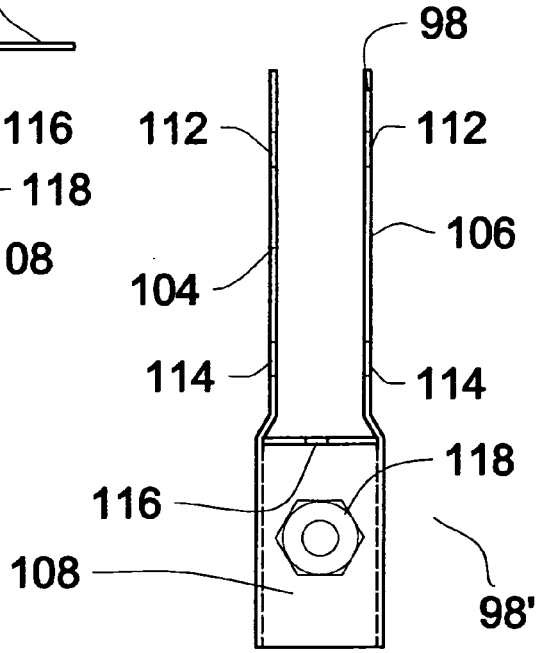
FIG. 12*a* is a front view of the top bracket of FIG. 11*a;*
Figure 14:
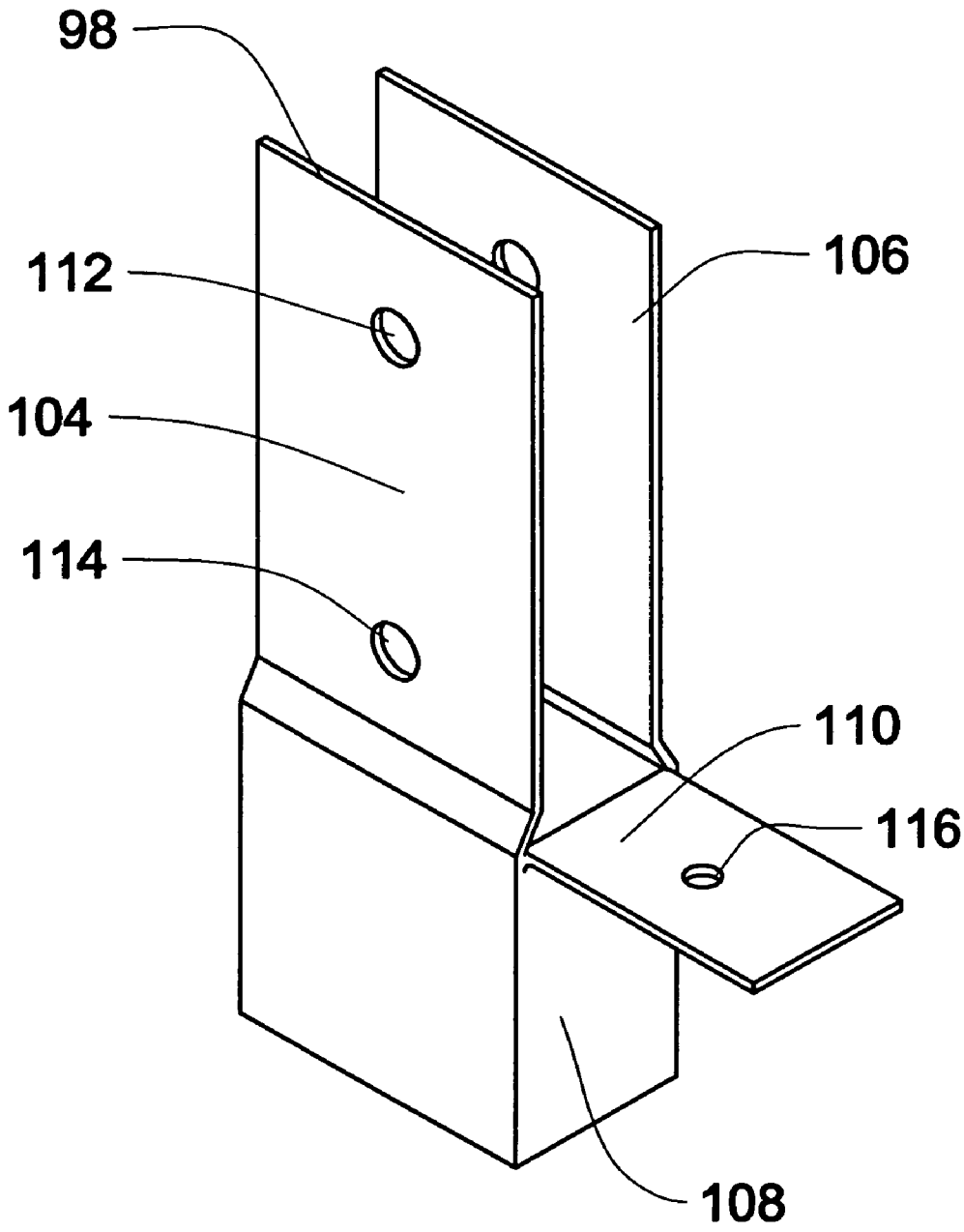
FIG. 14 is a bottom view of the top bracket of FIG. 11.

FIG. 11*a* is an enlarged side view of the modified top bracket 98'; FIG. 12*a* is an enlarged front view of the modified top bracket 98' and FIG. 13*a* is an enlarged bottom view of the modified top bracket 13*a*. The top bracket 98 is modified by attaching a nut 118 or the like to the connecting member 108. With reference to FIG. 8*a*, a threaded bolt 119 is threaded into the nut 118. The threaded bolt 119 is threaded into the nut 118 to force an upper end of the beam 96 against a top of the wall 94 to correct any misalignment thereof.

Figure 15:
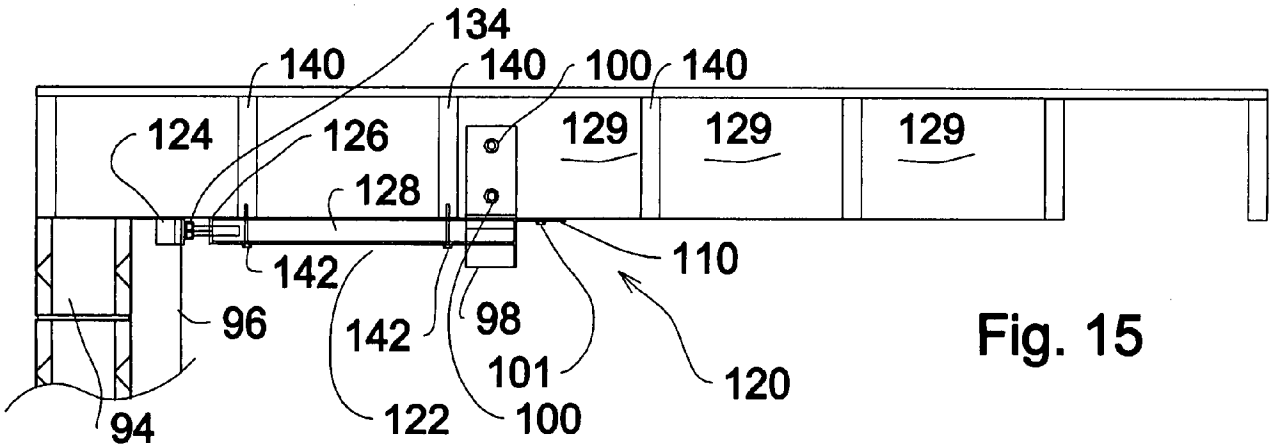
FIG. 15 is a side view of yet another embodiment of a wall restraint system utilizing an offset top connector in accordance with the present invention.
Figure 15A:
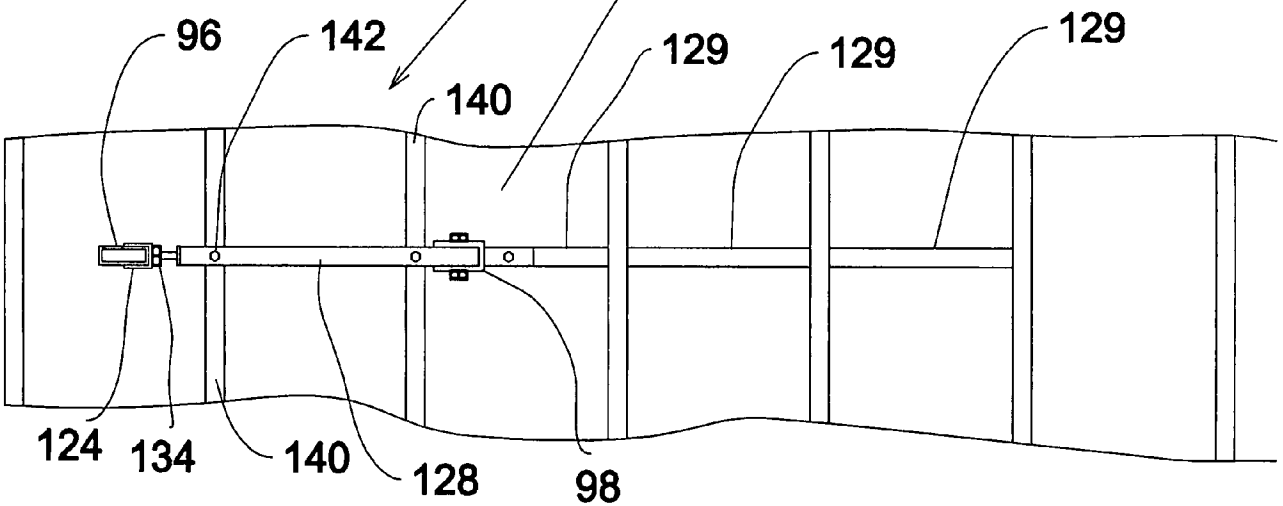
FIG. 15*a* is a bottom view of a wall restraint system utilizing an offset top connector in accordance with the present invention.
Figure 16:
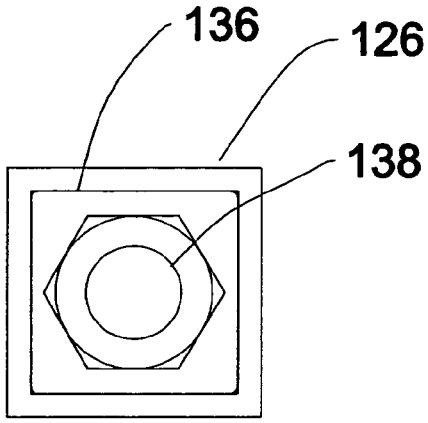
FIG. 16 is an enlarged end view of an end cap receiver of a wall restraint system of FIG. 15.
Figure 16A:
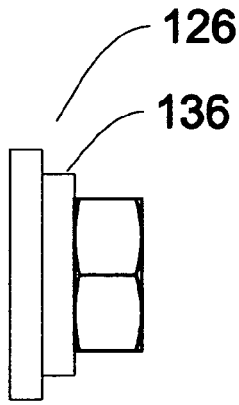
FIG. 16*a* is an enlarged side view of an end cap receiver of a wall restraint system of FIG. 15.
Figure 17:
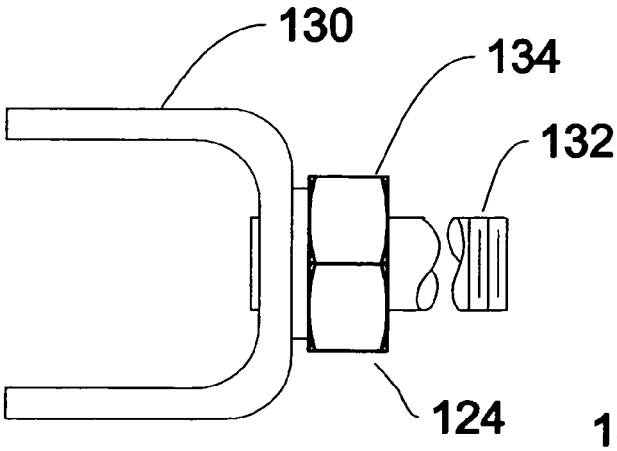
FIG. 17 is an enlarged top view of an adjustment yoke of a wall restraint system of FIG. 15.
Figure 17A:
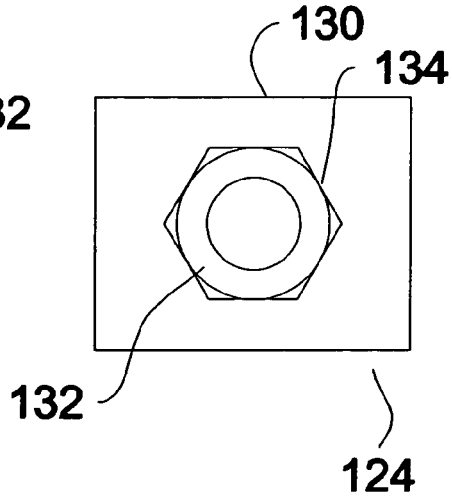
FIG. 17*a* is an enlarged end view of an adjustment yoke of a wall restraint system of FIG. 15.

FIG. 15 illustrates a side view of a wall restraint system 120 utilizing an offset top connector 122. FIG. 15*a* illustrates a bottom view of the wall restraint system 120. The offset top connector 122 includes the beam 96, an adjustment yoke 124, a threaded end cap 126, a thrust tube 128, the top bracket 98 and at least two floor beam supports 129. Referring briefly to FIGS. 17 and 17*a*, the adjustment yoke 124 includes a yoke 130 and a threaded stud 132. The threaded stud 132 includes a hex perimeter 134. An end of the thread stud 132 is pivotally retained in the yoke 130 by flaring an end of the threaded stud 132 or with any other suitable process. Referring briefly to FIGS. 16 and 16*a*, the threaded end cap 126 is inserted into one end of the thrust tube 128. The threaded end cap 126 includes an inner perimeter flange 136 and an inner thread 138. The inner perimeter flange 136 is sized to be received by an inner perimeter of the thrust tube 128. The inner thread 138 may be a hex nut 134 attached to the inner perimeter flange 136 or extra material extending from the inner perimeter flange 136. The inner thread 138 is sized to threadably receive the threaded stud 132. The thrust tube 128 is bolted to two floor joists 140 with two fasteners 142. The top bracket 98 axially retains the other end of the thrust tube 128. A single floor beam support 129 is attached between two adjacent floor beams 140 with any suitable method. The top bracket 98 is bolted to one of the at least two floor beam supports 129 with fasteners 100. The hex perimeter 134 is rotated to force the beam 96 against the wall 94.

Figure 18:
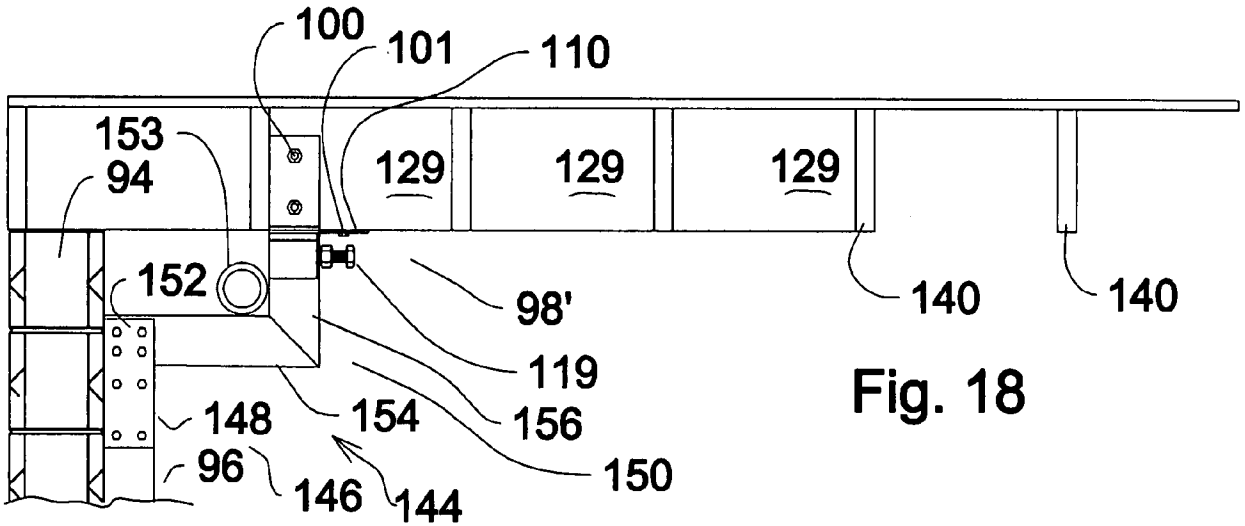
FIG. 18 is a side view of a wall restraint system utilizing an offset beam in accordance with the present invention.
Figure 18A:
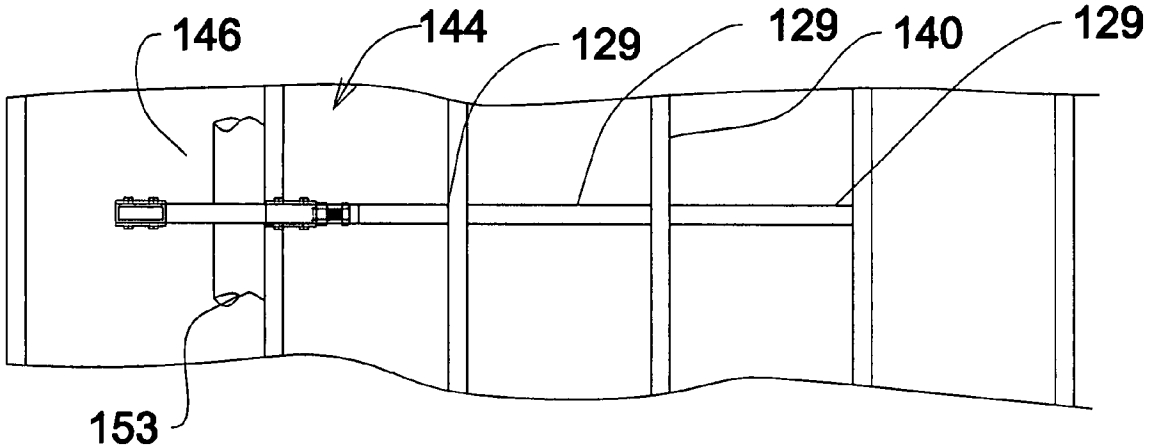
FIG. 18*a* is a bottom view of a wall restraint system utilizing an offset beam in accordance with the present invention.
Figure 19:
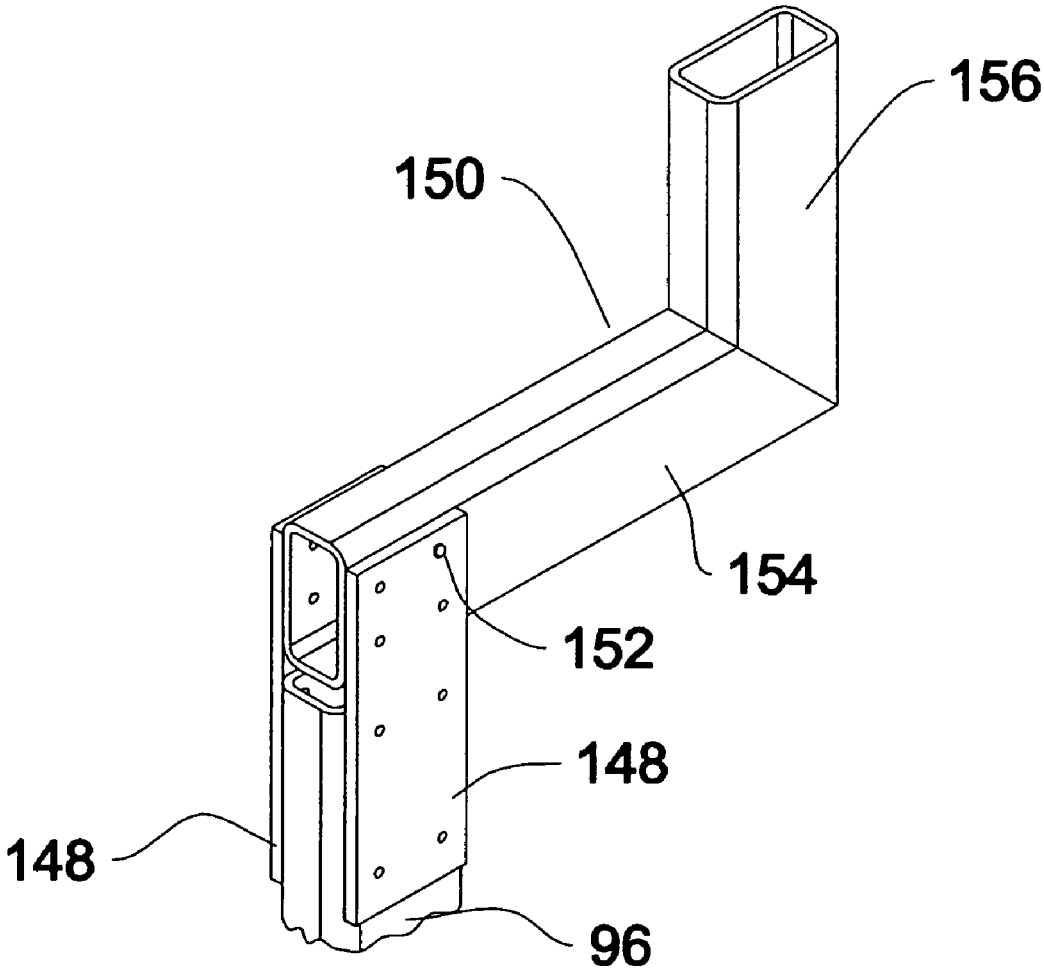
FIG. 19 is an enlarged perspective view of an offset beam of a wall restraint system of FIG. 17.

FIG. 18 illustrates a side view of a wall restraint system 144 utilizing an offset beam connector 146. FIG. 18*a* illustrates a bottom view of the wall restraint system 144. Referring briefly to FIG. 19, the offset beam 146 includes the beam 96, a pair of fastening plates 148, a right angle tube 150 and a plurality of fasteners 152. The offset beam 146 is used, when piping 153 or the like is obstructing attachment of the top bracket 98 or modified top bracket 98'. The right angle tube 150 includes a first tube 154 and a second tube 156. One end of the first tube 154 is mitered with a 45 degree angle and one end of the second tube 156 is mitered with a 45 degree angle. The mitered ends of the first and second tubes are preferably attached to each other with welding or any other suitable process. A single fastening plate 148 is attached to an end of the beam 96 and a non-mitered end of the first tube 154 on opposing sides thereof with the plurality of fasteners 152. The single floor beam support 129 is attached between two adjacent floor joists 140 with any suitable method. The top bracket 98, or modified top bracket '98 is attached to one of the at least two floor beam supports 129 with at least two fasteners 100. A non-mitered end of the second tube 156 is retained in the top bracket 98, '98. The top bracket 98, 98' axially retains the other end of the thrust tube 128. The threaded bolt 119 of the modified top bracket 98' is rotated to force the beam 96 against the wall 94.

While the invention has been described with reference to preferred embodiments, those skilled in the art will appreciate that certain substitutions, alterations and omissions may be made to the embodiments without departing from the spirit of the invention. Accordingly, the foregoing description is meant to be exemplary only, and should not limit the scope of the invention as set forth in the following claims.

What is claimed is:

1. A wall restraint system comprising:

a vertically disposed beam;

a top bracket having a first lower side member, a second lower side member and a connecting member, said connecting member being terminated by said lower first side member on a first end and said lower second side member on a second end, a first offset section extends from a top of said first lower side member, a second offset section extends from a top of said second lower side member, a bottom of a first side member extends from said first offset section, a bottom of a second side member extends from said second offset section, a distance between said first and second lower side members is greater than a distance between said first and second side members; and a traverse member extending outward from a top of said connecting member, said first and second lower side members being spaced apart to receive one end of said vertically disposed beam, said first and second side members are spaced apart to receive a floor joist, said traverse member is adapted to be secured to the floor joist with at least one fastener, said first side member, said second side member and the floor joist are adapted to have at least two fasteners inserted therethrough.

2. The wall restraint system of claim 1, further comprising:

a female thread being formed in a front of said connecting member, a threaded fastener being engaged with said female thread.

3. The wall restraint system of claim 2, further comprising:

said female thread being a hex nut secured to said front of said connecting member.

4. The wall restraint system of claim 1, further comprising:

the vertically disposed beam being retained against a wall, the other end of the vertically disposed beam being secured to a floor.

5. The wall restraint system of claim 1, further comprising:

said vertically disposed beam having a rectangular tubular cross section, a bottom bracket being secured to the floor, the other end of said vertically disposed beam being retained by said bottom bracket.

6. The wall restraint system of claim 1, further comprising:

said traverse member extending substantially perpendicular from said connecting member.

7. A wall restraint system comprising: a vertically disposed beam;

a top bracket having a first lower side member, a second lower side member and a connecting member, said connecting member being terminated by said lower first side member on a first end and said lower second side member on a second end, a first offset section extends from a top of said first lower side member, a second offset section extends from a top of said second lower side member, a bottom of a first side member extends from said first offset section, a bottom of a second side member extends from said second offset section, a distance between said first and second lower side members is greater than a distance between said first and second side members, said top bracket is fabricated from a single piece of material; and a traverse member extending outward from a top of said connecting member, said first and second lower side members being spaced apart to receive one end of said vertically disposed beam, said first and second side members are spaced apart to receive a floor joist, said traverse member is adapted to be secured to the floor joist with at least one fastener, said first side member, said second side member and the floor joist are adapted to have at least two fasteners inserted therethrough.

8. The wall restraint system of claim 7, further comprising:

a female thread being formed in a front of said connecting member, a threaded fastener being engaged with said female thread.

9. The wall restraint system of claim 8, further comprising:

said female thread being a hex nut secured to said front of said connecting member.

10. The wall restraint system of claim 7, further comprising:

the vertically disposed beam being retained against a wall, the other end of the vertically disposed beam being secured to a floor.

11. The wall restraint system of claim 7, further comprising:

said vertically disposed beam having a rectangular tubular cross section, a bottom bracket being secured to the floor, the other end of said vertically disposed beam being retained by said bottom bracket.

12. The wall restraint system of claim 7, further comprising:

said traverse member extending substantially perpendicular from said connecting member.

13. A wall restraint system having a top bracket in combination with a vertically disposed beam wall, comprising: a vertically disposed beam;

said top bracket having a first lower side member, a second lower side member and a connecting member, said connecting member being terminated by said lower first side member on a first end and said lower second side member on a second end, a first offset section extends from a top of said first lower side member, a second offset section extends from a top of said second lower side member, a bottom of a first side member extends from said first offset section, a bottom of a second side member extends from said second offset section, a distance between said first and second lower side members is greater than a distance between said first and second side members; and a traverse member extending outward from a top of said connecting member, one end of said vertically disposed beam is retained between said first and second lower side members, said first and second side members are spaced apart to receive a floor joist, said traverse member is adapted to be secured to the floor joist with at least one fastener, said first side member, said second side member and the floor joist are adapted to have at least two fasteners inserted therethrough.

14. A wall restraint system having a top bracket in combination with a vertically disposed beam wall of claim 13 wherein:

said vertically disposed beam having a rectangular tubular cross section.

15. A wall restraint system having a top bracket in combination with a vertically disposed beam wall of claim 13, further comprising:

a female thread being formed in a front of said connecting member, a threaded fastener being engaged with said female thread.

16. A wall restraint system having a top bracket in combination with a vertically disposed beam wall of claim 15 wherein:

said female thread being a hex nut secured to said front of said connecting member.

17. A wall restraint system having a top bracket in combination with a vertically disposed beam wall of claim 13 wherein:

said vertically disposed beam being retained against a wall, the other end of said vertically disposed beam being secured to a floor.

18. A wall restraint system having a top bracket in combination with a vertically disposed beam wall of claim 13, further comprising:

a bottom bracket being secured to the floor, the other end of said vertically disposed beam being retained by said bottom bracket.

19. A wall restraint system having a top bracket in combination with a vertically disposed beam wall of claim 13 wherein:

said traverse member extending substantially perpendicular from said connecting member.

* * * * *